United States Patent [19]

Mikoshiba et al.

[11] Patent Number: 4,987,120

[45] Date of Patent: Jan. 22, 1991

[54] THERMOSENSITIVE TRANSFER MATERIAL

[75] Inventors: Hisashi Mikoshiba; Mitsugu Tanaka; Seiiti Kubodera, all of Kanagawa, Japan

[73] Assignee: Fuji Photo Film Co., Ltd., Kanagawa, Japan

[21] Appl. No.: 416,207

[22] Filed: Oct. 2, 1989

[30] Foreign Application Priority Data

Oct. 5, 1988 [JP] Japan ..... 63-251214

[51] Int. Cl.[5] ..... B41M 5/035; B41M 5/26

[52] U.S. Cl. ..... 503/227; 8/471; 428/195; 428/336; 428/484; 428/488.1; 428/913; 428/914

[58] Field of Search ..... 8/471; 428/195, 913, 428/914, 336, 484, 488.1; 503/227

[56] References Cited

U.S. PATENT DOCUMENTS 4,829,047 5/1989 Niwa et al. ..... 428/211

FOREIGN PATENT DOCUMENTS 3524519 7/1985 Fed. Rep. of Germany ..... 503/227
4917744 6/1972 Japan ..... 503/227
1241191 10/1986 Japan ..... 503/227
2225564 10/1987 Japan ..... 503/227
0633062 1/1988 Japan ..... 428/195

*Primary Examiner*—Bruce H. Hess
*Attorney, Agent, or Firm*—Sughrue, Mion, Zinn, Macpeak & Seas

[57] ABSTRACT

A thermosensitive transfer material comprising a support having thereon a dye donating layer containing a dye represented by formula (I) and/or (II):

(I)

(II)

wherein $R^1$ represents a hetero ring containing at least one oxygen or nitrogen atom;

$R^2$, $R^3$, $R^4$, $R^5$, $R^6$, $R^7$, $R^8$, $R^{11}$, $R^{12}$, $R^{13}$, $R^{14}$ and $R^{15}$, which may be the same or different, each represents a hydrogen atom, an alkyl group, an alkoxy group, a halogen atom, an acylamino group, an alkoxycarbonyl group, a cyano group, an alkoxycarbonylamino group, an aminocarbonylamino group, a carbamoyl group, a sulfamoyl group or a sulfonylamino group;

$R^9$ and $R^{10}$, which may be the same or different, each represents a hydrogen atom, an alkyl group or an aryl group; and at least one combination of $R^6$ and $R^9$, and $R^7$ and $R^{10}$ may be combined to form a ring, or $R^9$ and $R^{10}$ may be combined to form a ring.

7 Claims, No Drawings

THERMOSENSITIVE TRANSFER MATERIAL

FIELD OF THE INVENTION

This invention relates to thermosensitive transfer materials.

BACKGROUND OF THE INVENTION

At present, intensive work has been made on thermosensitive transfer methods, electro-photographies and ink jet methods, etc., in color hard copy technology. The thermosensitive transfer method has many advantages in comparison with other methods because of its lower apparatus and material costs as well as easy maintenance and operation of the apparatus.

In thermosensitive transfer methods, either a thermosensitive transfer material comprising a heat fusible ink layer on a support film is heated with a thermal head to record the fused ink on a transfer sheet, or a thermosensitive transfer material comprising a sublimable dye donating layer is heated with a thermal head to sublime the color material (dye) on the transfer sheet. In the latter sublimation transfer method, since the amount of color material transfer varies with the energy input to the thermal head, gradation recording can easily be attained, as a result this is especially advantageous in full color recording of high picture quality.

However, there are many restrictions on the sublimable color materials (sublimable dyes) in that very few of them meet all the performance requirements.

Examples of performance requirements thereof are good spectral characteristics for color reproduction, easy sublimation, excellent light and heat fastness, resistant to various chemicals, less reduction in sharpness, difficulty in image retransfer, easy synthesis and easy manufacture of the thermosensitive materials (ink sheets). It is particularly demanded that cyan dyes can be developed to meet these requirements.

Various cyan dyes for thermosensitive transfer applications have been proposed. The indoaniline dyes described in the specification of JP-A-61-268493, JP-A-61-31292, and JP-A-61-35994 have relatively better performance (the term "JP-A" as used herein means an unexamined published Japanese patent application). However, they do not meet all the performance requirements of cyan dyes for thermosensitive transfer applications. For instance, these cyan dyes have insufficient spectral absorption, insufficient light and heat fastness, tendency for reduction in the sharpness of the transferred images, easy retransfer, and insufficient solubility in various solvents. Because they have optical interaction with yellow dyes or magenta dyes, the light fastness of green blue regions, and black regions of the images is inferior to the fastness of the single cyan dye regions. They interact optically with other cyan dyes and the images from their combination have inferior light fastness to that of the single dye. Other defects are: insufficient gloss or images, poor preservative property of ink sheet, poor ink dispersion properties, high cost, synthesis difficulties and raw material safety.

SUMMARY OF THE INVENTION

An object of this invention is to provide thermosensitive transfer materials containing cyan dyes which do not have the aforementioned prior art defects.

The above and other objects of this invention will be more apparent from the following description.

The above objects of this invention are achieved by a thermosensitive transfer material comprising a support having thereon a dye donating layer containing a dye represented by formula (I) and/or (II):

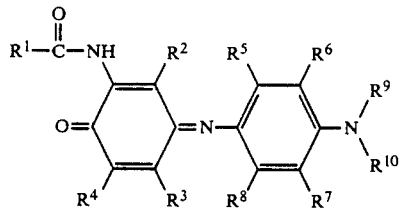

(I)

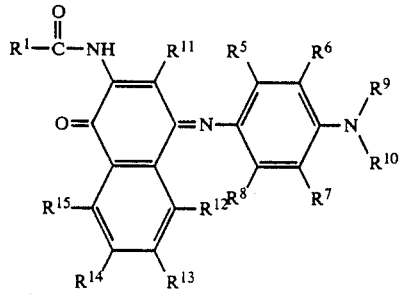

(II)

wherein $R^1$ represents a hetero ring containing at least one oxygen or nitrogen atom;

$R^2$, $R^3$, $R^4$, $R^5$, $R^6$, $R^7$, $R^8$, $R^{11}$, $R^{12}$, $R^{13}$, $R^{14}$ and $R^{15}$, which may be the same or different, each represents a hydrogen atom, an alkyl group, an alkoxy group, a halogen atom, an acylamino group, an alkoxycarbonyl group, a cyano group, an alkoxycarbonyl amino group, an aminocarbonylamino group, a carbamoyl group, a sulfamoyl group, or a sulfonyl amino group;

$R^9$ and $R^{10}$, which may be the same or different, each represents a hydrogen atom, an alkyl group, or an group; and at least one of $R^6$ and $R^9$, and $R^7$ and $R^{10}$ may be combined to form a ring, or $R^9$ and $R^{10}$ may be combined to form a ring.

DETAILED DESCRIPTION OF THE INVENTION

The dyes of formulae (I) and (II) are described in greater detail below.

$R^1$ represents a hetero ring containing at least one oxygen atom or nitrogen atom, with 5- to 6-membered hetero rings containing 1 to 3 hetero atoms being preferred. Examples thereof include a furan ring, a tetrahydrofuran ring, a pyridine ring, a piperidine ring, a pyrrole ring, a pyrrolidine ring, a tetrahydropyran ring, an imidazole ring, a pyrazole ring, a thiazole ring, a pyrazolone ring, and a thiodiazole ring. These rings can be substituted with alkyl groups having 1 to 5 carbon atoms (such as methyl, ethyl, isopropyl, and methoxyethyl) an alkoxy group having 1 to 5 carbon atoms (such as methoxy, ethoxy, isopoxy, and methoxymethoxy) an aryl group having 6 to 10 carbon atoms (such as phenyl and p-tolyl), a halogen atom (fluorine, chlorine and bromine), a nitro group, a cyano group, an alkoxy carbonyl group having 2 to 6 carbon atoms (such as methoxycarbonyl, and ethoxycarbonyl) an acylamino group having 1 to 10 carbon atoms (such as acetylamino, butylamino and benzolamino) or an amino group having up to 5 carbon atoms (such as $NH^2$, methylamino, diethylamino). The hetero ring of $R^1$ can be a condensed with saturated or unsaturated carbon rings or other hetero rings. Specific examples of $R^1$ include 2-furyl, 3-furyl, 2-(3-methyl)furyl, 2-(5-methyl)furyl, 2-(5-ethyl)furyl, 2-(5-chloro)furyl, 2-(5-bromo)furyl, 2-(4-isopropyl)furyl, 2-(3-nitro)furyl, 2-(5-ethoxycarbonyl)furyl, 2-(4,5-dimethyl)furyl, 2-(4,5-dichloro)furyl, 3-(2-cyano-5-bromo)furyl, 2-(3,4-diphenyl)furyl, 2-benzofuryl, 2-tetrahydrofuryl, 4-tetrahydropyranyl, 2-pyridyl, 3-pyridyl, 4-pyridyl, 2-(4-methyl)pyridyl, 2-(4-chloro)pyridyl, 2-(4-amino) pyridy 2-(4-propyl)-pyridyl, 2-( 4-methoxy)pyridyl, 2-(5-methyl)pyridyl, 2-(6-methyl)pyridyl, 2-(3-methoxycarbonyl)pyridyl, 2-(3-cyano)pyridyl, 2-(6-phenyl)pyridyl, 3-(6-methyl)-pyridyl, 2-(4,6-dimethyl)pyridyl, 4-(2-chloro-6-ethoxy)-pyridyl, 2-quinolyl, 3-quinolyl, 3-piperidyl, 4-(1-methyl)piperidyl, 2-(1-methyl)pyrolyl, 2-(1-methyl)pyrrolidyl, 2-(1-methyl)indolyl, 5-(1-methyl)imidazolyl, 2-(1-propyl)imidazolyl, and 2-(5-phenyl)-1,3,4-thiodiazolyl.

A 2-furyl group and a pyridyl group are preferred for $R^1$, and a 2-furyl group is particularly preferred for $R^1$.

Each of $R^2$ to $R^8$ and $R^{11}$ to $R^{15}$ independently represents a hydrogen atom, an alkyl group (including substituted alkyl groups, preferably having 1 to 12 carbon atoms such as methyl, ethyl, isopropyl, isobutyl and methoxyethyl), an alkoxy group (including substituted alkoxy groups preferably having 1 to 12 carbon atoms such as methoxyethoxy, isoproxy and methoxyethoxy), a halogen atom (fluorine, chlorine, and bromine), an acylamino group (including substituted acylamino groups, preferably alkylcarbonylamino groups having 1 to 10 carbon atoms such as acetylamino, propionylamino, and isobutyrylamino, arylcarbonylamino groups having 7 to 15 carbon atoms such as benzoylamino, and p-tolylamino), an alkoxycarbonyl group (including substituted alkoxycarbonyl groups, preferably having 2 to 10 carbon atoms such as methoxycarbonyl, ethoxycarbonyl, and isopropoxy carbonyl), a cyano group, an alkoxycarbonylamino group (including substituted alkoxycarbonylamino groups, preferably having 2 to 10 carbon atoms such as methoxycarbonylamino, ethoxycarbonylamino, and isopropoxycarbonylamino), an aminocarbonylamino group (including substituted aminocarbonylamino groups, preferably having 1 to 10 carbon atoms such as methylcarbonylamino, dimethylcarbonylamino, and dibutylcarbonyl amino), a carbamyl group (including substituted carbamyl groups, preferably having 1 to 12 carbon atoms such as methylcarbamyl group, dimethylcarbamyl, dibutylcarbamyl and phenylcarbamyl), a sulfamoyl group (including substituted sulfamoyl groups, preferably having 1 to 12 carbon atoms such as methylsulfamoyl, dimethylsulfamoyl, butylsulfamoyl and phenylsulfamoyl), or a sulfonylamino group (including substituted sulfonylamino groups, preferably having 1 to 10 carbon atoms, such as methanesulfonylamino, ethane sulfonylamino, N-methylmethanesulfonylamino, and phenylsulfonylamino).

Hydrogen atoms are preferred for $R^2$, $R^6$, $R^7$, $R^8$, $R^{12}$, $R^{13}$, $R^{14}$, and $R^{15}$.

A hydrogen atom, an alkyl group having 1 to 4 carbon atoms and an acylamino group having 1 to 3 carbon atoms are preferred for $R^3$. Of these groups a methyl group is most preferred for $R^3$.

A hydrogen atom, a halogen atom (chlorine and bromine) and an alkyl group having 1 to 3 carbon atoms are preferred for $R^4$. A chlorine atom is most preferred for $R^4$.

A hydrogen atom, an alkyl group (having 1 to 3 carbon atoms), an alkoxy group (having 1 to 3 carbon atoms) a halogen atom (fluorine, chlorine and bromine), an acylamino group (having 2 to 4 carbon atoms), an alkoxycarbonyl group (having 2 to 4 carbon atoms), an alkoxycarbonylamino group (having 2 to 4 carbon atoms) and a sulfonylamino group (having 1 to 3 carbon atoms) are preferred for $R^5$.

$R^9$ and $R^{10}$ each represents a hydrogen atom, an alkyl group (including substituted alkyl groups, preferably having 1 to 12 carbon atoms such as methyl, ethyl, propyl, isopropyl, butyl, sec-butyl, tert-butyl, benzyl, hexyl, and octyl) or an aryl group (including substituted aryl groups, preferably having 6 to 12 carbon atoms such as phenyl, p-tolyl and m-chlorophenyl).

The alkyl group for $R^9$ and $R^{10}$ can be substituted with an alkoxy group (such as methoxy and ethoxy), an aryl group (such as phenyl and p-tolyl), an acyl group, a halogen atom (fluorine, chlorine and bromine), an alkoxycarbonyl group (such as methoxycarbonyl, ethoxycarbonyl, and isopropoxycarbonyl), an aminocarbonyl group (such as methylaminocarbonyl, ethylaminocarbonyl and N,N-dimethylaminocarbonyl), an acylamino group (such as acetylamino, ethylcarbonylamino and benzoylamino), a hydroxyl group, an alkylcarbonyloxy group (such as methylcarbonyloxy and ethylcarbonyloxy), a sulfonylamino group (such as methylsulfonylamino acid phenylsulfonylamino). The aryl group $R^9$ and $R^{10}$ can be substituted with an alkyl group (such as methyl, ethyl and isopropyl) in addition to the substituent groups mentioned above for the alkyl group.

An alkyl group having 1 to 4 carbon atoms is most preferred for $R^9$ and $R^{10}$.

At least one of $R^6$ and $R^9$, and $R^7$ and $R^{10}$ may be combined to form a ring, or $R^9$ and $R^{10}$ may be combined to form a ring.

Preferred examples of the ring include those of the following formulae.

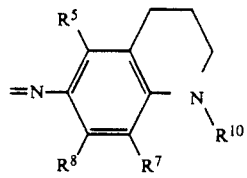

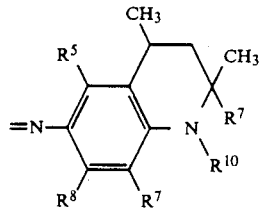

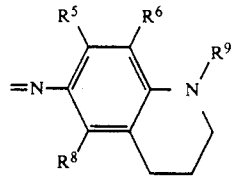

-continued

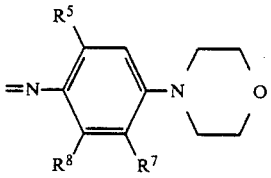

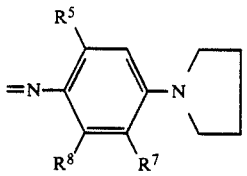

A hydrogen atom is preferred for $R^{11}$.

Among the dyes of the present invention, those represented by formula (I) are preferred.

Specific examples of dyes of formulae (I) and (II) are shown in the following table, but the present invention is not construed as being limited thereto. In the following table, Me represents methyl, Et represents ethyl, Pr represents propyl, i-Pr represents isopropyl and Bu represents butyl.

(I)

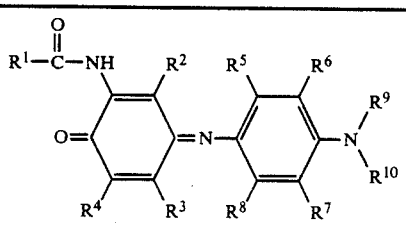

| Dye No. | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| 1 | 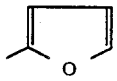 | H | Et | Cl | H | H | H | H | Et | Et |
| 2 | " | " | " | " | $-OCH_2$ | " | " | " | " | i-Pr |
| 3 | " | " | " | " | " | " | " | " | " | 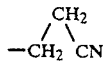 |
| 4 | " | " | " | " | $-\overset{H}{N}-\underset{\underset{O}{\|}}{C}-CH_3$ | " | " | " | " | $-CH_2CH_2CN$ |
| 5 | " | " | " | " | Me | " | " | " | " | $-CH_2CH_2-O-\overset{\overset{O}{\|}}{C}-CH_3$ |
| 6 | 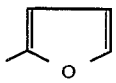 | H | Et | Cl | H | H | H | H | Et | Et |
| 7 | " | " | " | " | $-\overset{H}{N}-\underset{\underset{O}{\|}}{C}-OCH_3$ | " | " | " | " | Et |
| 8 | " | " | " | " | " | " | " | " | " | $-CH_2CH_2CN$ |
| 9 | " | " | Me | " | H | " | " | " | " | Et |
| 10 | " | " | " | " | $-OCH_3$ | " | " | " | " | " |
| 11 | " | " | " | " | " | " | " | " | " | $-CH_2CH_2-O-\overset{\overset{O}{\|}}{C}-CH_3$ |
| 12 | " | " | " | " | Me | " | " | " | " | Et |
| 13 | " | " | " | " | $-\overset{H}{N}-\underset{\underset{O}{\|}}{C}-CH_3$ | " | " | " | " | $-CH_2CH_2-\overset{\overset{O}{\|}}{C}-OCH_3$ |
| 14 | " | " | " | " | " | " | " | " | " | $-CH_2CH_2CN$ |

-continued

| | | | | | | | | | | |
|---|---|---|---|---|---|---|---|---|---|---|
| 15 | 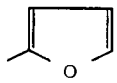 | H | Me | Cl | H<br>$-N-C-OCH_3$ | H | H | H | Et | Et |
| 16 | " | " | " | " | H<br>$-N-C-CH_3$<br>O | " | " | " | " | $-CH_2CH_2CN$ |
| 17 | " | " | H<br>$-N-C-CH_3$<br>O | H | H | " | " | " | " | Et |
| 18 | " | " | H<br>$-N-C$-i-Pr<br>O | " | $-OCH_3$ | " | " | " | " | " |
| 19 | " | " | " | " | H<br>$-N-C-OCH_3$<br>O | " | " | " | " | O<br>$-CH_2CH_2-O-C-CH_3$ |
| 20 | " | " | " | " | Me | " | " | " | " | " |
| 21 | 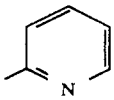 | " | Et | Cl | H | " | " | " | " | Et |
| 22 | 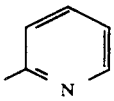 | H | Et | Cl | $-OCH_3$ | H | H | H | Et | O<br>$-CH_2CH_2-O-C-CH_3$ |
| 23 | " | " | " | " | H<br>$-N-C-OCH_3$<br>O | " | " | " | " | Et |
| 24 | " | " | " | " | " | " | " | " | " | $-CH_2CH_2CN$ |
| 25 | " | " | " | " | Me | " | " | " | " | O<br>$-CH_2CH_2-C-O-CH_3$ |
| 26 | " | " | " | " | H<br>$-N-C-OCH_3$<br>O | " | " | " | " | $-CH_2CH_2CN$ |
| 27 | 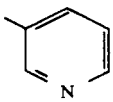 | " | " | " | H | " | " | " | " | Et |
| 28 | 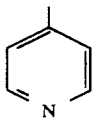 | " | " | " | " | " | " | " | " | " |
| 29 | 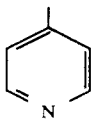 | H | H<br>$-N-C-CH_3$<br>O | H | H<br>$-N-C-CH_3$<br>O | H | H | H | Et | Et |
| 30 | 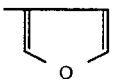 | " | Pr | Cl | H | " | " | " | Me | Pr |

-continued
| | | | | | | | | | | |
|---|---|---|---|---|---|---|---|---|---|---|
| 31 | 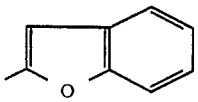 | " | Bu | Br | " | " | " | " | Bu | Bu |
| 32 | 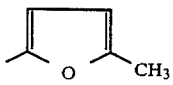 | " | Et | F | " | " | " | " | Pr | Pr |
| 33 | 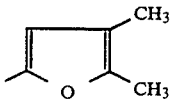 | " | " | Cl | Me | " | " | " | $-CH_2CH_2OCH_3$ | $-CH_2CH_2OCH_3$ |
| 34 | 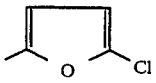 | " | " | " | " | " | " | " | Et | $-CH_2CH_2Cl$ |
| 35 | 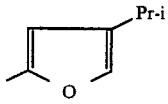 | H | Et | Cl | H | H | H | H | Et | Et |
| 36 | 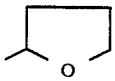 | " | " | " | Me | " | " | " | " | " |
| 37 | 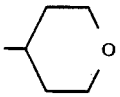 | " | " | " | H | " | " | " | " | " |
| 38 | 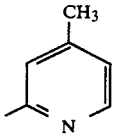 | " | " | " | " | " | " | " | " | " |
| 39 | 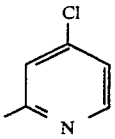 | " | " | " | " | " | " | " | " | " |
| 40 | 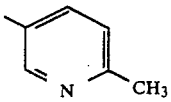 | " | " | " | " | " | " | " | " | " |
| 41 | 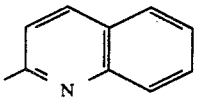 | " | Me | " | " | " | " | " | " | " |
| 42 | 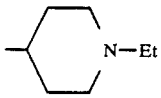 | H | Et | Cl | Me | H | H | H | Et | Et |
| 43 | 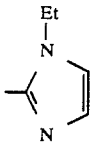 | " | " | " | H | " | " | " | " | " |

-continued
| | | | | | | | | | | |
|---|---|---|---|---|---|---|---|---|---|---|
| 44 | 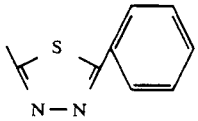 | " | " | " | " | " | " | " | " | " |
| 45 | 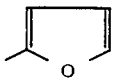 | " | $CH_3$ | H | $-NHCOCH_3$ | " | " | " | H | " |
No. 46
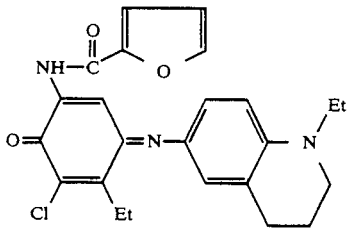
No. 47
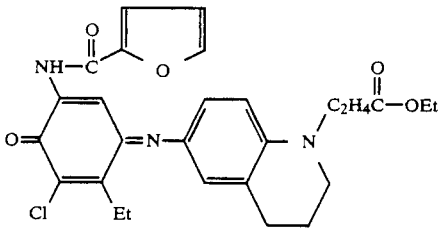
No. 48
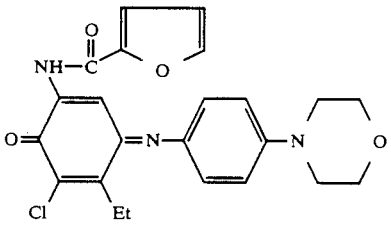
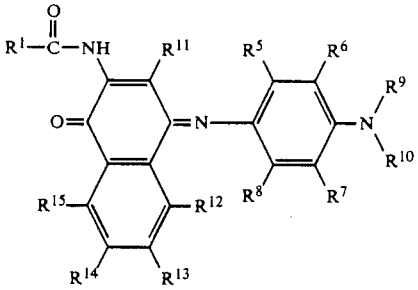
(II)
| Dye No. | $R_1$ | $R_{11}$ | $R_{12}$ | $R_{13}$ | $R_{14}$ | $R_{15}$ | $R_5$ | $R_6$ | $R_7$ | $R_8$ | $R_9$ | $R_{10}$ |
|---|---|---|---|---|---|---|---|---|---|---|---|---|
| 49 | 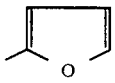 | H | H | H | H | H | H | H | H | H | Et | Et |
| 50 | " | " | " | " | " | " | $OCH_3$ | " | " | " | " | " |
| 51 | " | " | " | " | " | " | $-\overset{H}{N}-\underset{O}{\underset{\|}{C}}-CH_3$ | " | " | " | " | $-CH_2CH_2CN$ |

-continued

| | | | | | | | | | | | | |
|---|---|---|---|---|---|---|---|---|---|---|---|---|
| 52 | " | " | " | " | " | " | $-\overset{H}{N}-\underset{\underset{O}{\|}}{C}-OCH_3$ | " | " | " | " | " |
| 53 | " | " | $-\overset{H}{N}-\underset{\underset{O}{\|}}{C}-CH_3$ | " | " | " | H | " | " | " | " | " |
| 54 | " | " | $-\overset{H}{N}-SO_2-CH_3$ | " | " | " | " | " | " | " | " | $-CH_2CH_2CN$ |
| 55 | 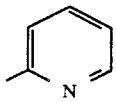 | H | H | H | H | H | H | H | H | H | Et | Et |
| 56 | " | " | " | " | " | " | $-OCH_3$ | " | " | " | " | " |
| 57 | " | " | " | " | " | " | $-\overset{H}{N}-\underset{\underset{O}{\|}}{C}-CH_3$ | " | " | " | " | " |
| 58 | " | " | $-\overset{H}{N}-\underset{\underset{O}{\|}}{C}-CH_3$ | " | " | " | " | " | " | " | " | " |
| 59 | 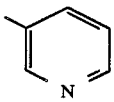 | " | H | " | " | " | H | " | " | " | " | " |
| 60 | 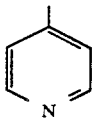 | " | " | " | " | " | " | " | " | " | " | $-CH_2CH_2CN$ |
| 61 | 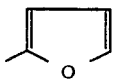 | " | " | " | " | " | $-\overset{H}{N}-\underset{\underset{O}{\|}}{C}-CH_3$ | " | " | " | H | Et Et |
| 62 | " | " | " | " | " | " | $-CH_3$ | " | " | " | " | " |
| 63 | " | " | " | " | " | " | $-\overset{H}{N}-\underset{\underset{O}{\|}}{C}-CH_3$ | " | " | " | " | " |

No. 64

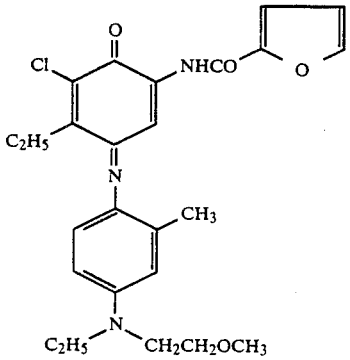

No. 65

-continued

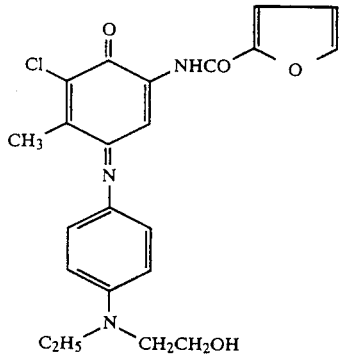

No. 66

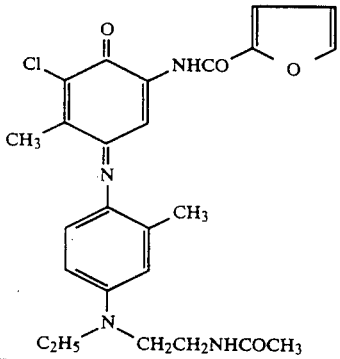

Among the above exemplified dyes, those represented by formula (I) are preferred, and Dye No. 1 is most preferred.

The dyes used in this invention can be synthesized by oxidation coupling reaction in accordance with the following:

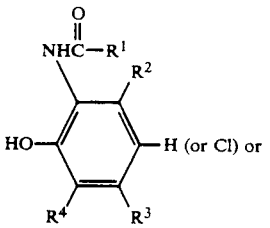

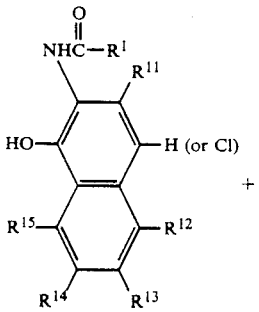

-continued

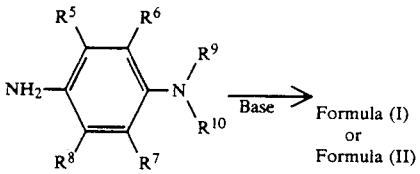

The following example is given to illustrate the synthesis of the dye used in the present invention. Unless otherwise indicated herein, all parts, percents, ratios and the like are by weight.

SYNTHESIS OF DYE NO. 1

Into a 5.0 l three necked flask, 45 g of 2-furoylamino-5-ethyl-4,6-dichlorophenyl, 1.6 l of ethyl acetate, 0.8 l of ethanol were charged and stirred at room temperature, and 150 g of sodium carbonate in 1.2 l of water followed by 31 g of p-amino-N,N-diethylaniline sulfate were added thereto. 28 g of ammonium persulfate in 200 g water was then added dropwise. After agitating for 30 minutes, extraction with ethyl acetate and removal of the solvent under reduced pressure, a crude product was obtained . The refined product obtained by silica gel chromatography (25 g, 59% yield, m.p. 117° to 118° C.).

Other dye compounds of the present invention can be synthesized using the above method in an analogous manner.

A feature of the thermosensitive transfer materials of this invention is the use of the aforementioned dyes of formulae (I) and (II) in the dye donating layer.

A first embodiment of the present invention is a thermosensitive transfer material in which the dye donating layer is a thermosensitive sublimation transfer layer which is described in more detail below.

The thermosensitive sublimation transfer materials of this invention can be obtained by preparing a coating solution with a suitable solvent in which the dye of this invention and the binder resin are dissolved or dispersed, then coating the solution on one surface of the substrate in a dry thickness of about from 0.2 to 5.0 μm, preferably from 0.4 to 2.0 μm, and drying to form a thermosensitive transfer layer on the support.

Conventional binder resin can be used with the dye of the present invention. Those with high heat resistance and which offer no hinderance to dye migration when they are heated are appropriate. Specific examples thereof include: polyamide resins, epoxy resins, polyurethane resins, polyacrylic resins (such as polymethyl methacrylate and polyacrylamide), polyvinylpyrrolididone derived vinyl resins, polyvinyl chloride resins (such as vinyl chloride-vinyl acetate copolymers etc.) polycarbonate resins, polyphenylene oxides, cellulose resins (such as methyl cellulose, ethyl cellulose, carboxylmethyl cellulose, cellulose acetate hydrogen phthalate, cellulose acetate, cellulose acetate propionate, cellulose acetate butyrate, and cellulose triacetate, etc.), polyvinyl alcohol resins (such as polyvinyl alcohol and partially saponified polyvinyl alcohol from polyvinyl butyral etc.), petroleum resins, rosin derivatives, cumarone-indene resins, terpene resins, novolac type phenolic resins, polystyrene resins, polyolefin resins (such as polyethylene and polypropylene).

Preferably, the binder resin is used in an amount of about from 80 to 600 parts by weight, more preferably from 80 to 200 parts by weight, per 100 parts by weight of the dye.

Conventional ink solvents can be used to dissolve or disperse the above described dye and binder resin to prepare an ink composition. Specific examples thereof induce water, alcohols such as methanol, ethanol, isopropyl alcohol, butanol, and isobutanol etc., esters such as ethyl acetate and butyl acetate, etc., ketones such as methyl ethyl ketone, methyl isobutyl ketone and cyclohexanone, etc., aromatics such as toluene, xylene and chlorobenzene, etc., halogenated hydrocarbons such as dichloromethane, trichloroethane, chloroform, etc., N,N-dimethyl formamide, N-methyl pyrrolidone, dioxane, tetrahydrofuran, etc., cellosolves such as methylcellosolve and ethylcellosolve or mixtures of the above solvents. It is important to select the solvent to dissolve or disperse fully the binder resins and achieve a higher dye concentration.

For example, about 9 to 20 times by weight of solvent based on the total weight of the above described dye and the binder resin should be used.

The dye of the present invention may be used singly or in combination.

The dye of this invention can also be mixed with conventional dyes.

The dye of this invention can be used in combination with conventional color fading inhibitor.

Conventional substrates with adequate heat resistance and strength can be used for the thermosensitive transfer materials of this invention. Examples thereof include regular paper, processed paper, polyester (such as polyethyleneterephthalate), polyamide, polycarbonate, glacine paper, condensed paper, cellulose ester, fluoropolymer, polyether, polyacetal, polyolefin, polyimide, polyphenylene sulfite, polypropylene, polystyrene, cellophane and polyimide. The thickness of the support is preferably from 0.5 to 5.0 μm, more preferably from 3 to 10 μm. Polyester films are particularly preferred as a substrate.

The methods for coating the ink composition on the support include reverse coating, gravure coating, rod coating, air doctor coating or the like.

The thermosensitive transfer materials of this invention may be used as it is. However, better images at higher thermal transfer temperatures can be obtained if adhesion between the thermosensitive transfer materials and the recording sheet is prevented by providing an adhesion prevention layer, namely a releasing layer, on the surface of the dye donating layer containing the dye.

An effective releasing layer is formed by simply adhering an inorganic powder with an adhesion prevention property to the dye donating layer. A releasing layer having a thickness of from 0.01 to 5 μm, preferably from 0.05 to 2 μm, can be made with a silicone polymer, an acylic polymer, or a fluoro polymer with good separation property.

Furthermore, these effects can be achieved by incorporating the above-described inorganic powder or polymer having separating property into the layer containing the dye.

A heat resistant layer on the surface of the thermosensitive transfer materials of this invention to prevent adverse effects of the thermal head such as sticking.

The dye transfer concentration is improved by using a dye-barrier layer of a hydrophilic polymer between the substrate and the dye donating layer in the materials of this invention.

When the above thermosensitive sublimation transfer material of this invention is superposed on the conventional image receiving material and is heated, on either side and preferably on the surface of the thermosensitive transfer material, with a thermal head actuated by an image signal, the dye in the dye donating layer is transferred onto the receiving layer of the receiving material with relatively low energy input thereby forming sharp images with good resolving gradation.

A preferred embodiment of the thermosensitive transfer materials of this invention can be produced in the form of sheets continuous ribbons or rolls. They can include only the cyan dye layer of the formula (I) or (II) of this invention, but yellow, magenta as well as black dye layers may be provided on separate portions of the material.

In the preferred embodiment of the thermosensitive transfer material of this invention, a sequentially arrangement of each layer of sublimable yellow, magenta, and cyan (black in some case) dyes is repeated.

In order to attain full color recording by using such an embodiment of the thermosensitive transfer materials, when the cyan dye donating layer (cyan dye region) of the ribbon or roll is pressed against a receiving material, a heat pattern corresponding to a single scanning line of picture elements is generated by a head element of the thermal head which is actuated on the cyan color signal. The cyan image for the whole picture is transferred to the receiving layer of the receiving material by repeating the above recording of one scanning line by moving the thermosensitive transfer material and the receiving material for one scanning line width. The same transfer recording operations are then repeated sequentially for the yellow and magenta (black in some cases) layers.

Conventional recording apparatus such as that disclosed in JP-A-62-1585 can be used for such full color recording.

The dyes of this invention can be applied in a thermosensitive transfer materials which operates other than by a sublimation transfer method. That is, a second embodiment this invention comprises a thermofusible layer containing a wax and the dye of this invention. Such a thermofusible transfer material is obtained by formation of a thermofusible transfer layer provided on one side of a substrate. The thermofusible layer comprises a wax having a suitable melting point (preferably from 20° to 200° C., more preferably from 40° to 120° C.) such as paraffin wax, microcrystalline wax, carnauba wax, and urethane series wax, etc. as a binder in which the dyes are dispersed therein. The ratio of the dye the wax is preferably from about 10 to 65 wt %, more preferably from 30 to 60 wt %, of dye based on the amount of the thermofusible transfer layer of which thickness is preferably in the range of from 1.5 to 6.0 μm. The manufacture and application of the thermofusible transfer layer to the substrate can be carried out in accordance with any known techniques. When the above-described second embodiment of the thermosensitive transfer material of this invention is used in the same manner as the first embodiment, the thermofusible transfer layer are transferred to the recording sheet (receiving material) resulting in images of good quality.

The dyes represented by formulae (I) and (II) are preferably used for the above first embodiment, i.e., the thermosensitive sublimation transfer materials.

Since the above-described dyes represented by formulae (I) and (II) of this invention have a bright cyan color, they are suitable for full color recordings of good color reproduction when combined with magenta and yellow dyes. Because they easily sublime and have a high molecular absorption coefficient, high color density recordings are attained at high speed without high load on the thermal head. Furthermore, since they are stable against heat, light, moisture and chemicals, records of good keeping property can be obtained because there is no thermal decomposition during transfer recording. Since the dyes of this invention have good solubility in organic solvents and good dispersibility in water, it is easy to prepare a uniformly solubilized and dispersed concentrated ink compositions and thereby obtain a transfer sheet of uniformly and densely coated dye. Therefore, when using these transfer materials of the present invention, recorded images of good uniformity and color density are obtained.

The following examples are given to illustrate the present invention in greater detail, but the present invention is not construed as being limited thereto.

EXAMPLE 1

Manufacture of Thermosensitive Transfer Material

A coating composition for a thermosensitive transfer layer (1) having the following formulation was applied on a substrate of polyethylene terephthalate having a thickness of 6 μm which had been corona treated (Toray, Lumilar) by wire bar coating to form dry thickness of 1 μm. The back side of the support was covered with a stripping layer by coating a tetrahydrofuran solution of polyvinylstearate (0.3 g/m) in polyvinyl butyral (Butoparu 76, Monsanto) (0.45 g/m) to thereby produce thermosensitive transfer material (1) Coating Composition for Thermosensitive Transfer Layer (1):

| | |
|---|---|
| Dye (Dye No. 1) | 4 g |
| Polyvinyl butyral resin (Denkabutyral 500-A, made by Denki Kagaku Kogyo K.K.) | 4 g |
| Toluene | 40 ml |
| Methyl ethyl ketone | 40 ml |
| Polyisocyanate (Takenate D110N, made by Takeda Chemical Co., Ltd.) | 0.2 ml |

Thermosensitive Transfer Materials (2) to (6) as well as a Comparative Thermosensitive Transfer Material (a), as shown in Table 1, were produced by replacing Dye No. 1 with other dyes.

Manufacture of Transfer below Sheet Material

Image receiving materials were formed by applying a coating composition for the receiving layer (1) having the following formulation on a synthetic paper (Oushi Petrochemical Co., Ltd., YUPO-FPG-150) base of a thickness of 150 μm by wire bar coating to a dry thickness of 5 μm followed by drying in a dryer at 100° C. and for 30 minutes.

Coating Composition for Receiving Layer (1)

| | |
|---|---|
| Polyester resin (Vylon-290, made by Toyobo Co., Ltd.) | 20 g |
| Amino-modified silicone oil (KF-857, made by Shin-etsu Silicone Co., Ltd.) | 0.5 g |
| Methyl ethyl ketone | 85 ml |
| Toluene | 85 ml |
| Cyclohexanone | 30 ml |

The thermosensitive transfer material and the image receiving material were superposed such that the thermosensitive transfer layer and the receiving layer were in contact with each other, and printed with a thermal head on the substrate side of the thermosensitive transfer material under conditions of a thermal head energy of 0.25 W/dot, a pulse width of from 0.15 to 15 seconds and a dot density of 6 dot/mm. Bright images without transfer unevenness were obtained.

The reflection spectra of the recorded receiving materials were measured with a Hitachi spectrophotometer 340 equipped with an integration sphere. The brightness of the cyan color image was evaluated by a half value width which is the difference between the peak absorption wavelength and the wavelength at the half of the peak adsorption density on the short wavelength side.

The stability of the recorded transfer sheet materials was evaluated by storage for 7 days in a 60° C. incubator.

The heat fastness during dark heat storage was evaluated with the ratio of Status A reflection density measured before and after the storage test.

The results obtained are shown in Table 1.

TABLE 1

| Material No. | Dye No. | Half value width (nm) | Image density | Heat fastness (%) |
|---|---|---|---|---|
| (1) | 1 | 79 | 1.60 | 88 |
| (2) | 5 | 80 | 1.55 | 90 |
| (3) | 9 | 78 | 1.60 | 80 |
| (4) | 18 | 79 | 1.55 | 87 |
| (5) | 21 | 80 | 1.55 | 84 |
| (6) | 27 | 81 | 1.55 | 83 |

TABLE 1-continued

| Material No. | Dye No. | Half value width (nm) | Image density | Heat fastness (%) |
|---|---|---|---|---|
| (a) | (a) | 83 | 1.50 | 72 |

Comparative dye (a)

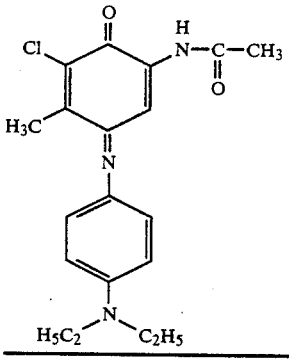

From the results in Table 1, it is understood that the dyes of the present invention provide sharp absorption spectra and are excellent in color reproduction in comparison to the comparative dye.

In addition to the above, the same procedures as above were repeated except that Dye Nos. 50, 57, 61, 62 and 63 were used. The excellent results similar to the above were obtained.

EXAMPLE 2

Manufacture of Thermosensitive Transfer Material

The coating composition (1) in Example 1 and a coating composition (b) in which Dye No. 1 was replaced by Comparative dye (b) were prepared. By using these compositions, thermosensitive materials (7) and (b) were prepared in the same manner as in Example 1.

Manufacture of Image Receiving Material

Image receiving materials were prepared in the same manner as in Example 1 except that the coating composition was replaced by the following composition (2).

Coating Composition for Receiving layer (2)

| | |
|---|---|
| Polyester resin (Vylon-280, made by Toyobo, Co., Ltd.) | 25 g |
| Amino-modified silicone oil (KF857, made by Shin-etsu Silicone Co., Ltd.) | 0.4 g |
| Isocyanate compound (KP-90, made by Dainippon Ink and Chemical Co., Ltd.) | 4 g |
| Methyl ethyl ketone | 85 ml |
| Toluene | 85 ml |
| Cyclohexanone | 30 ml |

The transfer recording was carried out in the same manner as in Example 1 to obtain images. The reflective density of the resulting images were measured The results are shown in Table 2 below.

TABLE 2

| Material No. | Dye No. | Image density |
|---|---|---|
| (7) | 1 | 1.50 |
| (b) | (b) | 1.40 |

Comparative dye (b)

TABLE 2-continued

| Material No. | Dye No. | Image density |
|---|---|---|

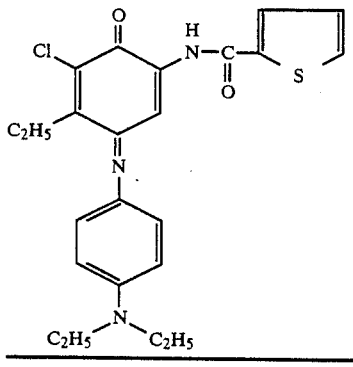

From the results in Table 2, it is understood that the dye of the present invention is excellent in transferred image density in comparison to the comparative dye.

While the invention has been described in detail and with reference to specific embodiments thereof, it will be apparent to one skilled in the art that various changes and modifications can be made therein without departing from the spirit and scope thereof.

What is claimed is:

1. A thermosensitive transfer material comprising a support having thereon a dye donating layer containing a binder and a dye represented by formula (I) and/or (II):

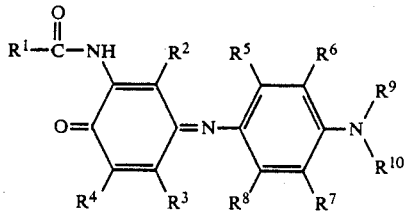

(I)

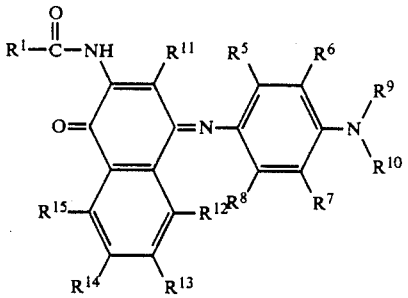

(II)

wherein $R^1$ represents furyl, tetrahydrofuryl, pyridy, piperidyl, pyrrolyl, pyrrolidyl, tetrohydropyranyl, imidazolyl, pyrazolyl, thiazolyl, pyrazolonyl or thiodiazolyl;

$R^2$, $R^3$, $R^4$, $R^5$, $R^6$, $R^7$, $R^8$, $R^{11}$, $R^{12}$, $R^{13}$, $R^{14}$ and $R^{15}$, which may be the same or different, each represents a hydrogen atom, an alkyl group, an alkoxy group, a halogen atom, an acylamino group, an alkoxycarbonyl group, a cyano group, an alkoxycarbonylamino group, an aminocarbonylamino group, a carbamoyl group, a sulfamoyl group or a sulfonylamino group;

$R^9$ and $R^{10}$, which may be the same or different, each represents a hydrogen atom, an alkyl group or an aryl group; and at least one combination of $R^6$ and $R^9$, and $R^7$ and $R^{10}$ may be combined to form a ring, or $R^9$ and $R^{10}$ may be combined to form a ring.

2. A thermosensitive transfer material as claimed in claim 1, wherein $R^2$, $R^6$, $R^7$, $R^8$, $R^{12}$, $R^{13}$, $R^{14}$ and $R^{15}$ each represents a hydrogen atom;

$R^3$ represents a hydrogen atom, an alkyl group having from 1 to 4 carbon atoms or an acylamino group having from 1 to 3 carbon atoms;

$R^4$ represents a hydrogen atom, a halogen atom or an alkyl group having from 1 to 3 carbon atoms;

$R^5$ represents a hydrogen atom, an alkyl group, an alkoxy group, a halogen atom, an acylamino group, an alkoxycarbonyl group, an alkoxycarbonylamino group or a sulfonylamino group;

$R^9$ and $R^{10}$, which may be the same or different, each represents a hydrogen atom or an alkyl group; and $R^{11}$ represents a hydrogen atom.

3. A thermosensitive transfer material as claimed in claim 1, wherein $R^1$ represents a 2-furyl ring or a pyridyl ring.

4. A thermosensitive transfer material as claimed in claim 1, wherein said coloring material layer is a thermosensitive sublimation transfer layer comprising said dye represented by formula (I) and/or (II) and a binder resin.

5. A thermosensitive transfer material as claimed in claim 4, wherein the thickness of said thermosensitive sublimation transfer layer is from about 0.2 to 5.0 μm; and the amount of said binder resin in said thermosensitive sublimation transfer layer is from about 80 to 600 parts by weight per 100 parts by weight of said dye.

6. A thermosensitive transfer material as claimed in claim 1, wherein said coloring material layer is a thermofusible transfer layer comprising said dye represented by formula (I) and/or (II) and a wax.

7. A thermosensitive transfer material as claimed in claim 6, wherein the thickness of said thermofusible transfer layer is from about 1.5 to 6.0 μm; and the amount of said dye is from about 10 to 65 wt % based on the total amount of said transfer layer.

* * * * *